US005127146A

United States Patent [19]

Wittenauer

[11] Patent Number: 5,127,146

[45] Date of Patent: Jul. 7, 1992

[54] METHOD FOR PRODUCTION OF THIN SECTIONS OF REACTIVE METALS

[75] Inventor: Jerome P. Wittenauer, Winterthur, Switzerland

[73] Assignee: Sulzer Brothers, Ltd., Winterthur, Switzerland

[21] Appl. No.: 704,760

[22] Filed: May 23, 1991

Related U.S. Application Data

[63] Continuation of Ser. No. 284,046, Dec. 14, 1988.

[51] Int. Cl.[5] ..... B23P 17/00; B21D 33/00

[52] U.S. Cl. ..... 29/423; 29/17.5; 29/17.6; 29/17.7

[58] Field of Search ..... 29/17.1, 17.4, 17.5, 29/17.6, 17.7, 17.8, 17.9, 423; 228/118; 427/423

[56] References Cited

U.S. PATENT DOCUMENTS

| | | | |
|---|---|---|---|
| 2,612,682 | 10/1952 | Burrack | 228/135 |
| 2,651,099 | 9/1953 | Roemer et al. | 29/17.5 |
| 2,835,022 | 5/1958 | Harris | 29/17.5 |
| 2,985,945 | 5/1961 | Nordheim et al. | 29/17.5 |
| 2,997,784 | 8/1961 | Petrovich et al. | 228/118 |
| 3,068,564 | 12/1962 | Wiedt, Jr. | 228/175 |
| 3,122,423 | 2/1964 | Hessler | 72/465 |
| 3,150,436 | 9/1964 | Bomberger | 29/17.6 |
| 3,164,884 | 1/1965 | Nobel et al. | 29/17.5 |
| 3,199,189 | 8/1965 | La Plante | 228/190 |
| 3,237,298 | 3/1966 | Ma | 29/460 |
| 3,286,337 | 11/1966 | Sauve | 29/423 |
| 3,315,335 | 4/1967 | Witt | 72/363 |
| 3,352,008 | 11/1967 | Fairbanks | 29/599 |
| 3,354,538 | 11/1967 | Cadden et al. | 29/423 |
| 3,375,695 | 4/1968 | Knapp | 72/366.2 |
| 3,481,013 | 12/1969 | Dannohl | 29/17.5 |
| 3,566,661 | 3/1971 | McCafferty et al. | 72/220 |
| 3,615,907 | 10/1971 | Perry, Sr. et al. | 148/13.1 |
| 3,658,517 | 4/1972 | Davies et al. | 419/36 |
| 3,729,046 | 4/1973 | Kennedy et al. | 164/46 |
| 3,998,601 | 12/1976 | Yates et al. | 428/607 |
| 4,168,978 | 9/1979 | Keonig | 430/294 |
| 4,344,998 | 8/1982 | de Leeuw et al. | 428/212 |
| 4,357,395 | 11/1982 | Lifshin et al. | 428/607 |
| 4,616,393 | 10/1986 | Beaueregard et al. | 29/423 |

OTHER PUBLICATIONS

"Roll Cladding in a Vacuum", *Advanced Materials & Processes, Inc., Metal Progress* Apr. 1988.

"Making Alloy Foils by Electron Beam Evaporation" *Metal Engineering Quarterly,* Feb. 1974.

"Rolling of Titanium and its Alloys in Vacuum" Krupin et al., Moscow *Institute of Steel and Alloys, Processings of the Third Inter-national Conference on Titanium,* May 1976, Plenum Press.

"Direct Cast Titanium Alloy Strip" Gaspar et al., *Ribbon Technology Corporation,* P.O. Box 30758, Gahanna, OH.

Mark's Standard Handbook for Mechanical Engineers Eighth Edition, 1978 pp. 13–47, 13–48, McGraw Hill.

*Primary Examiner*—Joseph M. Gorski
*Assistant Examiner*—S. Thomas Hughes
*Attorney, Agent, or Firm*—Dykema Gossett

[57] ABSTRACT

A method of forming thin metal sections of reactive metals which prevents high-temperature accelerated corrosion during hot working. The reactive metal section is placed in a non-reactive metal frame. Two non-reactive metal sections are machined to form depressions in which a release agent is deposited. The framed reactive metal section is interleaved between the two non-reactive metal sections such that the release agent is interposed between the principal surfaces of the reactive metal section and the non-reactive metal sections. The assembly is then clampled and welded together along the perimeter. The laminate structure is hot worked as by hot rolling to the desired gauge. The release agent flows to form a continuous barrier during hot working which prevents bonding of the non-reactive sections to the reactive metal section. Since the reactive metal section is encapsulated in a non-reactive metal jacket, oxidation and other degradation of the reactive metal section during hot working is prevented. When the formed assembly is cooled after hot working, the edges of the assembly are sheared off, and the protective metal jacket is stripped from the formed reactive metal section by virtue of the release agent.

1 Claim, 3 Drawing Sheets

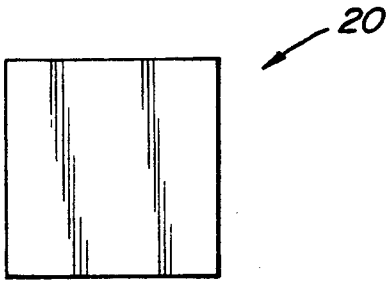
Fig-1
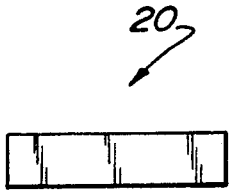
Fig-2
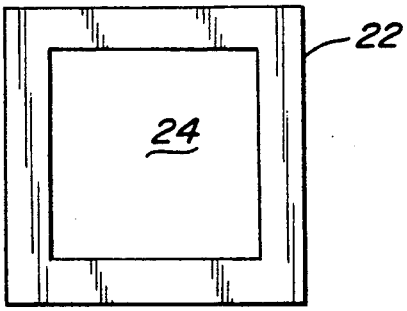
Fig-3
Fig-4
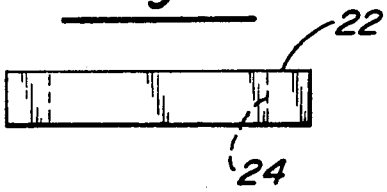
Fig-6
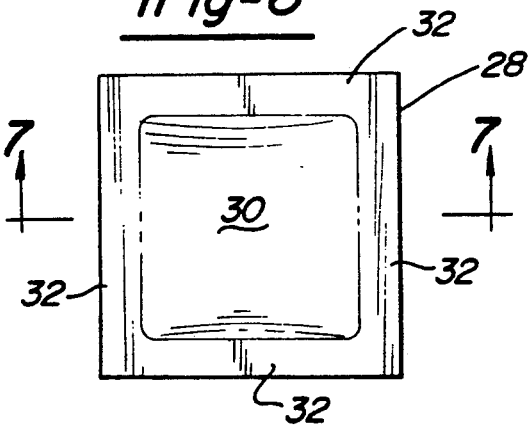
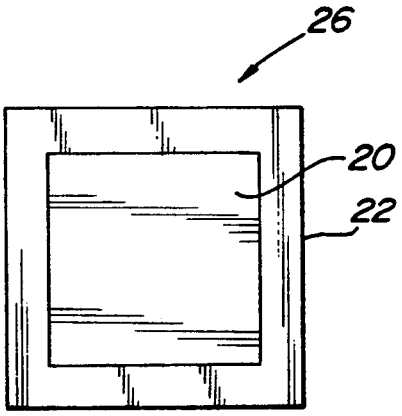
Fig-5
Fig-7
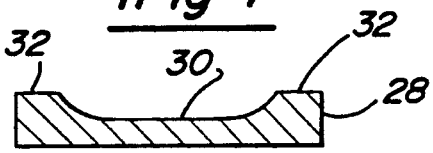
Fig-8
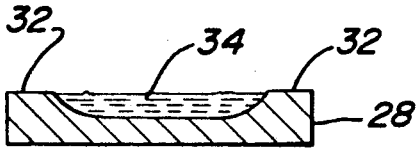

METHOD FOR PRODUCTION OF THIN SECTIONS OF REACTIVE METALS

This is continuation of copending application Ser. No. 07/284,046 filed in Dec. 14, 1988.

FIELD OF THE INVENTION

The present invention relates generally to the production of thin metal sections such as metallic foils from reactive metals and more specifically to a method which prevents oxidation and other degradation during hot working of metal sections.

BACKGROUND OF THE INVENTION

Deterioration and loss of metal due to corrosion generally increases at elevated temperatures, For example, the oxidation rate of titanium, iron, nickel, zinc, and the like, and refractory metals such as molybdeum, tungsten, niobium and tantalum is a primary concern at high temperatures where a rapid reaction between the metal and atmospheric oxygen occurs. In addition to loss of material due to oxidation, oxygen or other gaseous contamination often occurs by the diffusion of a gaseous species into a metal section. The formation of oxide layers on metal sufaces may affect the structural integrity of a metal section and decrease the capacity of a metal section to be bonded to another surface. Similarly, unwanted diffusion of a gas into a metal surface may produce a decrease in ductility. It is known that other unwanted metal degradation may also at elevated temperatures.

In order to reduce unwanted corrosion of metal sections, numerous corrosion-resistant alloys have been developed such as titanium alloys. However, even corrosion-resistant alloys may oxidize at an unacceptable rate during high-temperature processing. As will be appreciated by those skilled in the art, most metals are subjected to hot working at some point in the forming process. The need for elevated temperatures during metal processing and the resultant increase in metal degradation has produced a number of prior art techniques to eliminate corrosive atmospheres from the environment of the metal during high-temperature processing. For example, hot working in large vaccuum chambers or in inert gas environments is a common technique. However, the costly manufacturing facilities which are required in these processes add additional expense to the final product. In many applications, an oxide layer is removed from a metal section by machining or the like.

Numerous protective coatings have also been devised by which a highly corrosive resistant barrier is created on a metal surface. The most commonly used metallic coatings include tin, zinc, lead-tin alloys, nickel, chromium, cadmium, cooper, aluminum, bronze, brass, lead, iron and steel. These metallic coatings may be applied to a metal section using a variety of techniques such as hot dip processes where the article to be coated is immersed in a molten bath of the protective metal, by metal cementation where the protective metal is alloyed into the surface layer of the part, and by metal spraying. In metal spraying, the protectiv metal is heated and atomized while being propelled at a high velocity to the surface to be coated. As the molten particles impact the surface, they adhere firmly, providing a thin coating against corrosion.

Anther widely used method of applying a protective coating to a metal surface is known as metal cladding. In metal cladding, a metal core having poor corrosion resistance is surrounded by a corrosion-resistant metal to from a layered product. The cladding may be formed by casting or by electrolytic deposition of the protective coating on the core. Additionally, a metal section may be placed between two sheets of a corroision resistance metal, such as a section of flat steel placed between two sheets of aluminum. The assembly is then cold rolled to form a tri-laminate structure. Other cladding techniques such as fusion welding are also known. The clad article may then be further worked by extrusion, hot rolling, hot compaction, or other metal working techniques. In addition, it is known to apply protective coatingsd by other techniques such as cathode sputtering and evaporation/condensation deposition techniques. In many instances, where a protective coating is used only to encapsulate a metal section to prevent oxidation during processing, the encapsulant layer must then be removed either chemically or by various machining techniques.

In a number of applications, for example in the aerospace industry, dense, ductile metallic foils are often utilized. Although these foils may heve good corrosion resistance at ambient temperatures and in the vacuum of space, they may undergo an unacceptable level of oxidation at elevated temperatures. In the past, these foils have been manufactured using complicated and costly vaccum evaporation processes whereby a metal-bearing coating material is vaporized within a vacuum. A portion of the metallic content of the vaporized coating meterial is then condensed on a substrate. Metallic foils manufactured by flame spraying a molten on the surface of a substrate are also known. These methods typically employ a release agent on the substrate such as a fluoride salt to faciliate the removal or stripping of the foil from the surface of the substrate. Metal deposition techniques of this nature have been used both with static substrates and with moving substrates which pass through a deposition chamber or under a flame spray nozzle in a continuous fashion. Foils may also be prepared by the machining of cast articles or by hot rolling under vacuum.

In U.S. Pat. No. 2,997,784 to Petrovich et al., a method of making composite metal articles is described in which a release agent is placed between two metal slabs of cladding material. The base material to be cladded is then placed in juxtaposed relation with the non-coated surfaces of the cladding layers. The assembly is then welded around the edges and rolled to the desired thickness, whereby the base metal is pressure-bonded to the cladding. The marginal edges are then removed, and the two cladded slabs of base metal are separated. In is disclosed that calcium fluoride and other fluorides can be used as parting compounds which may be sprayed onto the cladding layers as an aqueous solution or slurry. It is also disclosed that the base metal can be applied to the cladding layers by placing the cladding layers between which the parting compound is disposed in a mold with the base metal being then cast in place around the cladding layers.

In U.S. Pat. No. 3,164,884 to Noble et al., a method for the multiple rolling of sheets is disclosed in which cover plates and side bars are assembled around inner plates separated by a separating compounds. The side bars are provided with vent holes and are welded along their outer edges to the cover plates and to each other.

The separating compounds which are disclosed include aqueous mixtures of oxides, slpecifically chromium, magnesium and aluminum oxides. The vent holes permit gases in the sandwich to escape during heating and rolling.

As will be appreciated by those skilled in the art, the prior art techniques of fabricating thin sheets or foils all have considerable drawbacks which make them undesirable in terms of cost, production capacity, and quality control. Therefore, it would be desirable to provide a cost-effective method of producing thin metal sections such as foils which reduces or eliminates destructive oxidation during high-temperature processing. The present invention achieves this goal by providing a method by which reactive metals can be formed into thin sections in a hot working process which can be carried out in an unmodified atmosphere at ambient pressure and which does not require complicated machining or chemical stripping of an encapsulant.

SUMMARY OF THE INVENTION

In accordance with the present invention, there is provided a method of thermomechanically forming a workpiece which is particularly suitable for forming thin metal sections of reactive metals. In essence, a metal workpiece is protected from high-temperature corrosion during hot working by placing the workpiece in a malletable metal enclosure with a film of a release agent interposed between major mating surfaces of the reactive metal section and the metal jacket. In a preferred embodiment, a metal section of a reactive metal is placed in a non-reactive metal frame. The reactive metal section and frame are then interposed between sections of non-reactive metals in the nature of top and bottom plates, with a release agent which exhibits viscous glass-like properties at high temperatures being disposed at the interfaces of the reactive metal section with the non-reactive metal sections. The release agent is preferably provided in shallow depressions or pockets in the non-reactive metal sections at the metal interfaces. The assembly is then welded together near the perimeter such that the release agent is sealed in place between the sections.

The welded assembly may then be hot rolled under pressure to the desired gauge using conventional hot rolling machinery and procedures to form thin metal sections or foils. Other hot working techniques may be employed where suitable. As the assembly is hot rolled, the release agent to form a uniform interfacial film. Thus, accelerated oxidation during the high-temperature hot working of the reactive metal section is prevented by the present invention by encapsulating the reactive metal section in a non-reactive metal jacket during hot working, with the major surfaces of the reactive metal core being separated from the encapsulant layers by a release agent.

Thereafter, the formed assembly or laminate is cooled, and the rolled assembly is sheared to move the welded edges. The non-reactive metal sections are simply peeled from the reactive metal core by virtue of the brittle, non-cohesive release agent. Residual release agents can be removed from the finished reactive metal foil by a rinse or the like. In this manner, the present invention provides a method by which quantities of reactive metals such as refractory metals can be formed into thin metal sections such as foils or strips without the use of vacuum processing equipment and with the utilzation of conventional hot working equipment such as hot rolling machinery.

The foregoing advantages and features of the invention will be more fully described in connection with the description of the preferred embodiment of the invention and in connection with the drawings in which:

BRIEF DESCRIPTION OF THE DRAWINGS

FIG. 1 is a plan view of a reactive metal sections.

FIG. 2 is a side elevation of the reactive metal section of FIG. 1. FIG. 3 is a plamn view of a non-reactive metal frame used in accordance with the present invention.

FIG. 4 is a side elevational view of the metal frame shown in Figure

FIG. 5 is a plan view of a reactive metal section installed in a non-reactive metal frame.

FIG. 6 is plan view of a non-reactive metal section used in forming the assembly of the present invention.

FIG. 7 is a cross-section of the non-reactive metal section of FIG. 6 along lines 7-7, illustrating a machined pocket in a principal surface of the non-reactive section.

FIG. 8 is a cross-sectional view of the metal section depicted in FIG. 7 with the pocket having been partially filled with a layer of release agent.

DETAILED DESCRIPTION OF THE PREFERRED EMBODIMENTS

Figure 9:
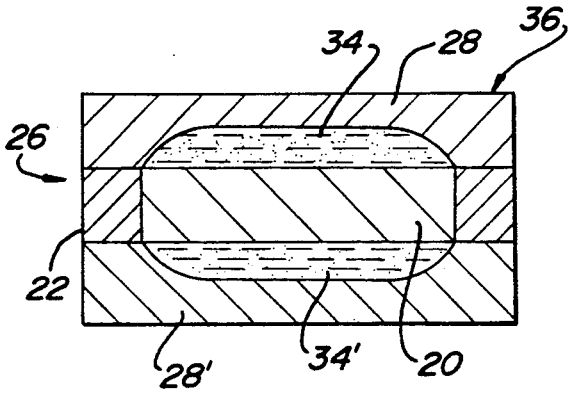
FIG. 9 is a cross-sectional view of the laminate assembly of the present invention.

Referring now to FIGS. 1 and 2 of the drawings, a metal section or layer 20 formed of a reactive metal is shown which is to be formed into a thin metal section such as a foil or strip. Metal section 20 is generally flat, having top and bottom principal surfaces. As used herein, reactive metal shall be defined as any metal, including alloys, which exhibits an increase in corrosion such as oxidation at temperatures higher than ambient temperature, It should be noted that the present invention is extremely useful in the production of thin sections of refractory metals which oxidize rapidly at elevated temperatures. In addition to the metal set forth in the background of the invention, the present is particularly useful in forming thin sections of titanium and titanium alloys such as titanium-aluminum-niobium alloys and titanium-aluminum-vanadium alloys. Molybdenum, niobium and tungsten, which are commonly used in the aerospace industry, are also preferred for use herein. The alloys Ti-6A1-4V and Ti-14A1-20N b-3.2V-2Mo are particularly preferred in the present invention. Many other pure metals and numerous alloys will be particularly suitable for metal forming by the method of the prsent invention. Hence, as will be recognized by those skilled in the art, by following the principles of the present invention, most metals can be processed as described herein.

Reactive metal section 20 is preferably cleaned throughly to reduce surface contanination, including the removal of any substantial native oxide layer. It may also be necessary to remove any temporary protective coatings. As will be explaned more fully herein, it may also be possible to form reactive metal section 20 from a metal powder.

Referring now to FIGS. 3 and 4 of the drawings, metal frame 22 is provided which will serve to encase the sides of reactive metal section 20 during processing. Non-reactive metal frame 22 includes window 24 which may be formed simply by cutting out a center section of frame 22. The thickness of reactive metal section 20 should be substantially the same as the thickness of non-reactive metal frame 22 and thus of window 24. Also, the relative geometries and dimensions of reactive metal section 20 and window 24 are such that reactive metal section 20 fits snugly within non-reactive metal frame 22, and more specifically within window 24 as shown in FIG. 5. Thus, FIG. 5 illustrates the placement of reactive metal section 20 in frame 22 to form frame assembly 26.

As used herein, the term "non-reactive metal" in connection with non-reactive metal frame 22 includes those metals which exhibit substantial corrosion resistance at high temperatures and should provide good formability by the hot working methods used in the present invention. A suitable non-reactive metal should also have the capacity to be welded successfully and should not develop any cracks or pores during processing which would allow gases to penetrate the encapsulant. A preferred material should also resist excessive spalling processing and provide adequate resistance against gas diffusion. While the thickness of reactive metal section 20 and metal frame 22 are not critical and will be dictated by the desired final gauge of the product, the processing equipment, and the number of passes utilized where the material is worked by hot rolling, the thickness of reactive metal section 20 will generally range from about 100 micrometers to about 10,000 micrometers, where the finished reactive metal foil is to have a thichness of from about 10 micrometers to about 1000 micrometers.

Where reactive metal section 20 is formed in place in frame 22 from a metal powder, the metal powder may be cold pressed into metal frame 22 using an appropriate die. A suitable powder should have substantial green strength without the use of a binder. Also, frame assembly 26 can be formed by first fabricating an ingot of the reactive metal and then casting a non-reactive around the ingot. Using the techniques, frame assembly 26 is formed simply by slicing off a section of the cast metallic structure.

A particularly preferred non-reactive metal for use in the present invention is stainless steel, most preferably type 316 stainless steel which is effective in the present invention at processing temperatures between about 950 degrees to about 1150 degrees C. Many other non-reactive metals are suitable, including nickel, copper, silver and their respective alloys. Also, it may be possible to use a reactive metal since, as will be more fully explained, the encapsulant or jacket material is stripped away from the finished reactive metal foil.

Referring now to FIG. 6 of the drawings, non-reactive metal section 28 is provided which will generally be formed of the same material of which frame 22 is formed with the same objectives of limiting high-temperature oxidation and providing adequate welding strength. Metal section 28 is provided with a depression or pocket 30 which is shown more clearly in FIG. 7 as a concave region or area generally centrally disposed in metal section 28. As can be seen in both FIGS. 6 and 7, depression 30 should be positioned within the perimeter or boundary defined by edge portions 32 of metal section 28. In other words, metal section 28 begins with a flat principal surface into which a central area is then machined to form centrally disposed pocket 30 with edge portions 32 retaining the original flat principal surface of metal section 28. As will be described more fully, depression or pocket 30 will serve to confine a release agent during processing.

Referring now to FIG. 8 of the drawings, depression 30 in metal section 28 is at least partially filled with a release agent 34 which will permit the removal of metal section 28 from the finished article which in this instance will be the foil formed from reactive metal section 20. There are several desirable characteristics of a suitable release agent. The release agent should exhibit glass-like behavior at the elevated temperatures and pressures at which the laminate structure of the present invention will be hot worked. The release agent should form a thin continuous film between non-reactive metal section 28 and the principal surfaces of reactive metal section 20 during processing. Of particular importance in the present invention, the release agent should be chemically inert with respect to the reactive metal so as to prevent contamination and degradation of the reactive metal at the elevated temperature of interest. Thus, oxides are not suitable. The release agent should also exhibit brittle, non-cohesive behavior at ambient temperature to facilitate the easy removal of metal section 28 from reactive metal section 20 following hot working. That is, the release agent should fracture readily at ambient temperatures after processing.

The preferred materials for forming a layer of release agent 34 are metal halides. Particularly preferred are fluoride salts. Suitable fluoride salts include lithium, sodium, magnesium, calcium, strontium, and barium fluoride. The release agent should also have a boiling point well in excess of the temperature at which hot working will be carried out. Sodium chloride may also be suitable for use as a release agent in the present invention. Thus, the most preferred release agents for use in the present invention are $CaF_2$, $MgF_2$, $LiF_2$, $BaF_2$, $SrF_2$ and NaCl, with calcium fluoride being the most preferred material for use as a release agent. To form layer 34, the release agent may be melted and evaporated onto metal section 28 in pocket 30 while masking edge portions 32. Warm pressed pure powder bars, hot pressured pure powder bars, or melted and cast pure powder bars of the release agent may be utilized. The purity of the release agent should be high, preferably above 99 percent. More preferably, the release agent is flame sprayed onto metal section 28 in cavity 30. Most preferably, the release agent is applied by preferably vacuum plasma spraying a dense, adherent layer of release agent. It has been found that this plasma spraying technique prevents the formation of air pockets in layer 34 that cause oxidation of reactive metal section 20 during subsequent processing.

As shown in FIG. 8, release agent 34 is housed within pocket 30 with the thickness of release agent layer 34 being preferably slightly less than the depth of pocket 30. The relative thicknesses of release agent layer 34 and metal section 28 are exaggerated in FIGS. 8 and 9 for the purposes of illustration. In general, the pre-worked thickness of release agent 34 should be such that after final hot working, release agent layer 34 is from about 0.01 micrometer to about 100 micrometers, more preferably from about 0.1 micrometer to about 40 micrometers and most preferably about 20 micrometers in thickness. Thus, prior to hot working, release agent layer 34 will generally have a thickness of from about 0.1 micrometer to about 2000 micrometers, more preferably from about 1.0 to about 1000 micrometers and most preferably about 500 micrometers. The depth of pocket 30 is dictated by the desired thickness of release agent layer 34.

If release agent layer 34 is too thin, it may not provide a continuous layer during processing. Any gaps may allow unwanted bonding between metal section 28 and reactive metal section 20. If this bonding occurs, it may hinder the subsequent separation or peeling of metal section 28 from reactive metal section 20 after hot working. Of course, the surfaces of non-reactive metal section 28 should be cleaned thoroughly prior to the application of release agent layer 34, and it may be necessary to also clean edge portions 32 prior to welding, as will be more fully explained.

Referring now to FIG. 9 of the drawings, laminate assembly 36 is shown which includes frame assembly 26 having frame member 22 in which reactive metal section 20 is disposed. Non-reactive metal section 28 having release agent layer 34 is placed in contact with frame assembly 26 such that release agent layer 34 contacts one side or principal surface of reactive metal section 20. On the opposite side of frame assembly 26, a second non-reactive metal section 28' is provided which includes a second release agent layer 34' disposed in a depression formed in metal section 28' in the same fashion as described in connection with fabrication of metal section 28. Thus, it will be understood that metal section 28' and release agent layer 34' are identical to metal section 28 and release agent layer 34 such that a "sandwich," laminate structure or assembly 36 is formed in which frame assembly 26 is interleaved between release agent layers 34 and 34' and encapsulated or jacketed by metal section 28, frame member 22 and metal section 28'. In some applications, it may be desirable to provide more than one assembly 36 and to stack several of the assemblies one on top of another to simultaneously form a number of reactive metal foils.

Figure 10:
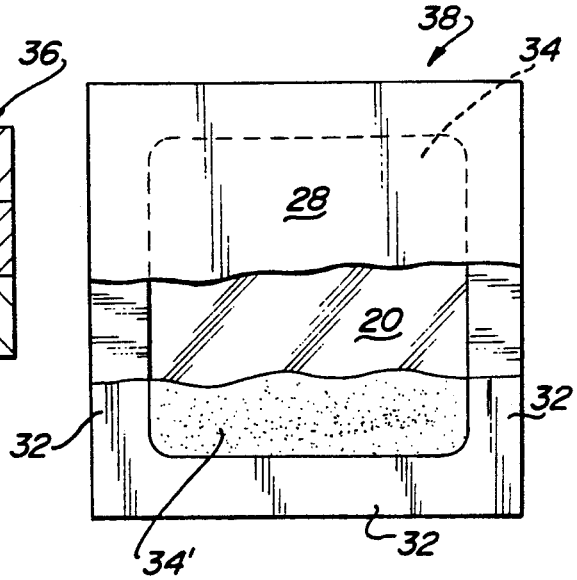
FIG. 10 is a plan view of the assembly of FIG. 9, partially broken away to illustrate the assembly layers.

Referring now to FIG. 10 of the drawings, assembly 36 is shown with portions of the various lamina partially removed to expose underlying layers. Assembly 36 is then clamped together and welded at its edges to seal metal section 20 and release agent 34 and 34' in the metal jacket defined by frame 22, non-reactive metal section 28 and non-reactive metal section 28'. Numerous welding techniques and weld orientations are suitable and will be known to those skilled in the art. The specific welding method utilized must be compatible with the characteristics of the non-reactive metal used to form metal section 34 and 34' and metal frame 22. The weld should be confined to the non-reactive metal and should not include reactive metal section 20. Thus, the weld line is preferably a continuous weld which secures sections 28 and 28' to frame 22 such that release agent layers 34 and 34' are sealed within their respective cavities. As will be understood by those skilled in the art, a continuous weld is desired to prevent atmospheric contamination of both the reactive metal 20 and of edge surfaces 32 while the laminate is heated to the desired processing temperature and prior to hot working deformation. This prevents liquified release agent from escaping as assembly 36 is spread during hot working. The depth of the weld penetration should provide adequate strength during at least the initial rolling pass to prevent slippage of the layers. Particularly preferred for use herein is electron beam welding performed in a vacuum which prevents entrapment of an air layer that may cause oxidation during processing. This completes preparation of welded laminate assembly 38.

Figure 11:
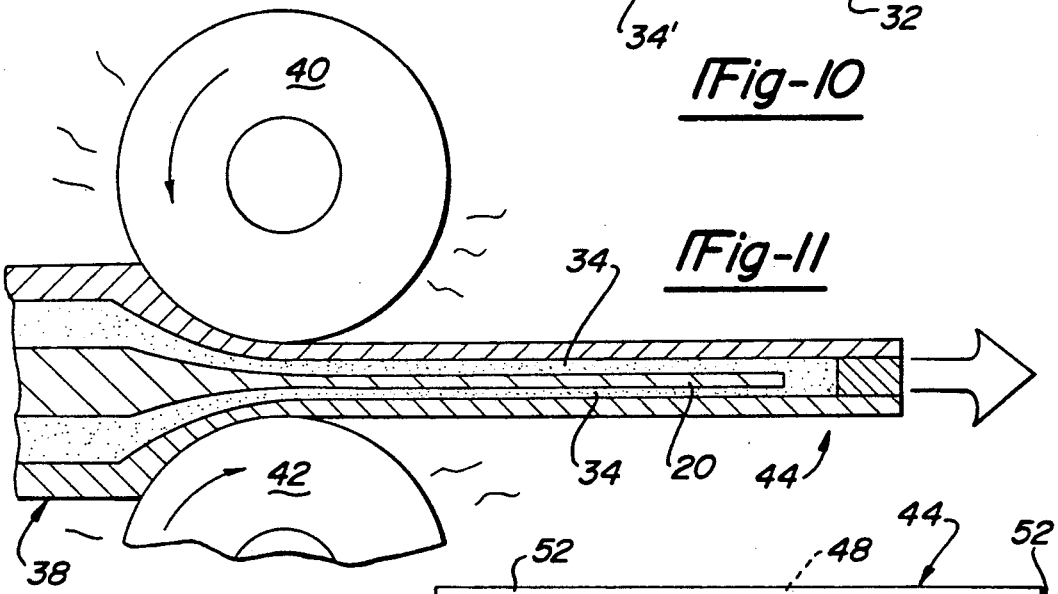
FIG. 11 is a diagramming representation of the welded assembly of FIG. 10 undergoing hot rolling between two rollers.

Referring now to FIG. 11 of the drawings, welded laminate assembly 38 is now processed by hot working or the like to form a thin metal section such as a reactive metal foil. It is anticipated that the present invention will be useful in producing thin metal sections of reactive metals having a thickness of about 10 micrometers to about 10,000 micrometers, preferably from about 50 micrometers to about 5,000 micrometers and most preferably in the production of foils from about 50 micrometers to about 2000 micrometers in thickness. While a number of hot working techniques can be used to work laminate assembly 38, such as hammering and pressing operations, hot rolling is particularly preferred. As will be known by those skilled in the art, hot rolling consists of passing a material between two revolving rollers at a predetermined temperature and pressure.

Referring now to FIG. 11 of the drawings, welded laminate assembly 38 is passed between rollers 40 and 42 in conventional hot rolling fashion such that the cross-section of welded laminate assembly 38 is reduced. This lateral spreading forms a thin laminate structure 44. At hot rolling temperatures, release agent layer 34 and 34' become viscous and flow to form a continuous film separating reactive metal section 20 from non-reactive metal sections 34 and 34' during the rolling process. It will be understood that the hot rolling temperature will be dictated by the temperature characteristics of the release agent as well as those of the metal laminae of laminate assembly 38. In forming titanium alloy foils where type 316 stainless steel is used to form the non-reactive metal sections and calcium fluoride is used as the release agent, the temperature during isothermal hot rolling should be maintained between about 800 degrees C to about 1000 degrees C. Multiple passes through rollers 40 and 42 may be suitable in some instances.

Figure 12:
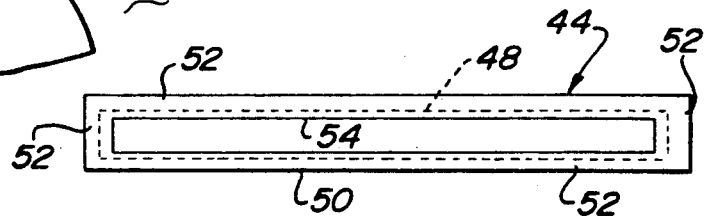
FIG. 12 is a plan view of the laminate assembly of FIG. 10 after hot rolling.

Formed laminate assembly 44 is shown in FIG. 12 with the reactive metal foil 48 shown in phantom. Assembly 44 is allowed to cool to a temperature at which the release agent exhibits brittle, non-cohesive properties. In some applications, it may be desirable to subject laminate assembly 44 to thermal treatment following hot rolling such as precipitation reactions, ordering transformations, or annealing to provide desired metallurgical characteristics. The selection of a chemically stable release agent such as $CaF_2$ is a distinct advantage of the present invention as it allows elevated temperature thermal treatment of the reactive metal without contamination or surface degradation of the as-rolled foil product. Such treatment is, of course, optional. Next, the non-reactive metal jacket or encapsulant 50 is stripped off in the following manner. Formed laminate assembly edges 52 are sheared off by an edge slitting machine such as a large press shear. The edges are sheared off just slightly inside the perimeter of reactive metal foil 48 with a shear line shown by reference number 54 in FIG. 12. The sheared laminate assembly 56 is shown in FIG. 12 ready for the removal of the remainder of non-reactive metal jacket 50.

Figure 13:
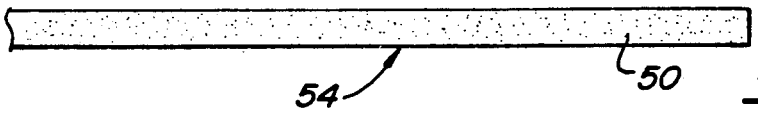
FIG. 13 is the hot work assembly of FIG. 12 after the welded edges have been sheared off.
Figure 14:
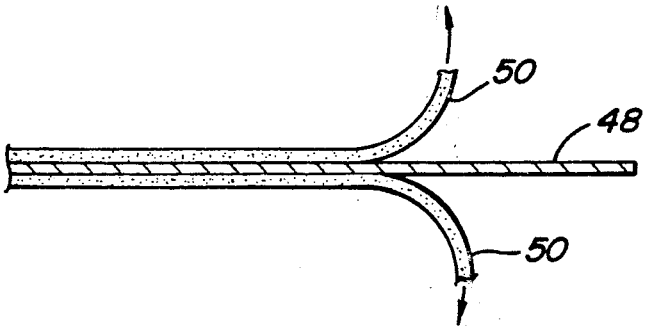
FIG. 14 is a side elevational view illustrating removal of non-reactive metal encapsulate layers from the formed reactive metal foil with the release agent not shown for simplicity.

Referring now to FIG. 13, non-reactive metal jacket 50 is simply peeled away from reactive metal foil 48. The release agent easily fractures, and peeling is preferably carried out after the release agent has reached ambient temperature. Most suitable stripping techniques and machinery will be known by those skilled in the art by which metal jacket 56 can be peeled from foil 48. Hence, in summary, ductile foils for the aerospace industry and other industries which are difficult to form due to accelerated oxidation during hot working can be formed conveniently by the present invention. Numerous other uses for large quantities of wide, thin sheets made in accordance with the present invention will be apparent to those skilled in the art. It is also contemplated that one facility may assemble the laminate structure to be delivered to a second facility for hot working such as a hot strip mill or universal plate mill. Moreover, the present invention can be used for the extrusion of structural sections using the inventive capsulation method and high-temperature extrusion processes.

EXAMPLE

Figure 15:
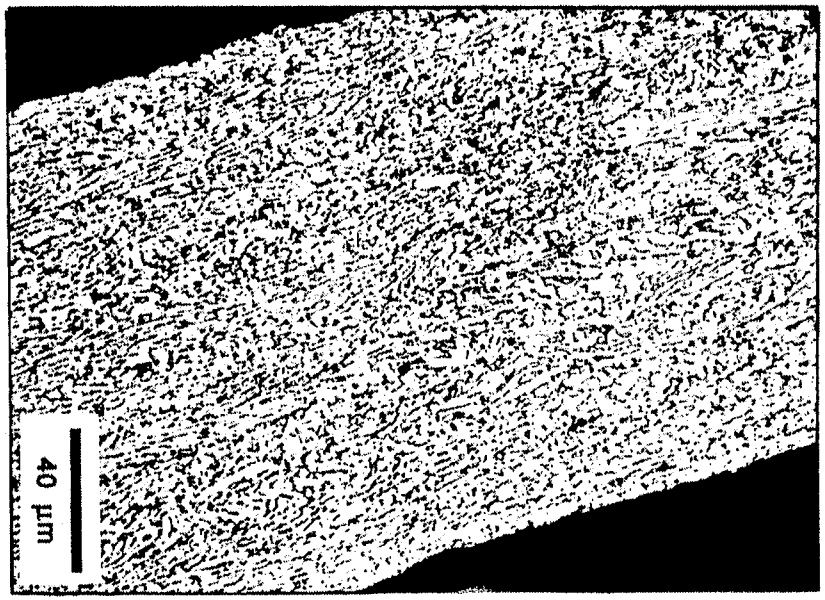

In order to demonstrate the effectiveness of the present invention, a titanium foil was prepared in the manner disclosed in the present invention in which calcium fluoride was utilized as a release agent. As shown in FIG. 15, which is a microphotograph of the titanium foil, the microstructure is completely homogenous with no evidence of chemical attack or surface degradation. The microstructure at the center of the foil is identical to that near the surface, further evidencing a lack of contamination of the surface. The microstructure pictured in FIG. 15 is of 180 micrometers Ti-6Al-4V foil which was hot-rolled from cold-pressed powder at 900 degrees C. Several starting materials were tested with oxygen analysis of the completed foils as shown in Table I below:

TABLE I

| Starting Material | Oxygen (wt. ppm) | Final Product | Oxygen |
|---|---|---|---|
| Ti—6Al—4V Powder | 1160 | 180 μm Foil | 1830 |
| Ti—6Al—4V Extruded Bar | 2000 | 110 μm Foil | 2300 |
| Ti—14Al—20Nb Casting | 510 | 220 μm Foil | 530 |
| Ti—14Al—20Nb Casting | 510 | 120 μm Foil | 650 |

While a particular embodiment of the invention is shown and described herein, it will be understood, of course, that the invention is not to be limited thereto since many modifications may be made, particularly by those skilled in this art, in light of this disclosure. It is contemplated therefore by the appended claims to cover any such modifications that fall within the true spirit and scope of this invention.

What is claimed is:

1. A method of shaping a metal comprising:

providing a first metal and a second metal, each metal having principle surfaces;

incorporating a release agent into only part of said principle surfaces of said second metal, thereby creating a flat, smooth surface of said second metal, only part of which is chemically inert with respect to said first metal;

encapsulating said first metal in said second metal, said release agent being disposed between said first and second metals, thereby creating a metal assembly;

forming said metal assembly to a pre-determined geometry with means for metal forming, thereby shaping said first metal; and stripping said second metal from said first metal.

* * * * *